United States Patent [19]

Pardini

[11] Patent Number: 4,983,788

[45] Date of Patent: Jan. 8, 1991

[54] ELECTRIC SWITCH MECHANISM FOR RELAYS AND CONTACTORS

[75] Inventor: Franco P. Pardini, Milan, Italy

[73] Assignee: CGE Compagnia Generale Electtromeccanica S.p.A., Milan, Italy

[21] Appl. No.: 369,531

[22] Filed: Jun. 21, 1989

[30] Foreign Application Priority Data

Jun. 23, 1988 [IT] Italy ..... 21478/88[U]

[51] Int. Cl.[5] ..... H01H 15/02; H01H 67/02

[52] U.S. Cl. ..... 200/16 R; 200/551; 335/132; 335/185

[58] Field of Search ..... 200/5 R, 6 R, 6 B, 6 BA, 200/6 BB, 6 C, 16 R, 537, 542, 547, 551, 573, 574; 335/185–187, 196–198, 200

[56] References Cited

U.S. PATENT DOCUMENTS

| | | | |
|---|---|---|---|
| 3,770,921 | 11/1973 | Wilbrecht | 200/16 R X |
| 3,949,333 | 4/1976 | Freitag et al. | 335/197 X |
| 4,507,627 | 3/1985 | Murata et al. | 200/16 R X |
| 4,540,859 | 9/1985 | Lemmer | 200/573 X |
| 4,712,079 | 12/1987 | Marquardt | 335/198 X |

*Primary Examiner*—J. R. Scott

*Attorney, Agent, or Firm*—Helfgott & Karas

[57] ABSTRACT

Electric switch mechanism for relays and contactors comprises a slider movable within a fixed housing and provided with cams which convert the movement of the slider into contact movement of contact pairs of the switch. The action of the slider with the cams to induce movement to the contacts is opposite to that of springs which apply closing forces to contact pairs.

4 Claims, 2 Drawing Sheets

ELECTRIC SWITCH MECHANISM FOR RELAYS AND CONTACTORS

SPECIFICATION BACKGROUND OF THE INVENTION

The present invention relates to an electric switch of the type in which at least two fixed contact arms are connected by at least a conducting bridge, having at least one movable contact pair opposed to at least one fixed contact pair on the fixed arms. Such a switch can be specifically employed in auxiliary switch blocks assembled on electromechanical devices, such as contactors or relays, in which the smallest possible force from actuating members is required in order to actuate contact closure and/or opening while the force applied to the closing contacts must be well higher than the force required from the actuating members.

In the contemporary electromechanical devices, such as contactors, many accessory devices such as latching devices, time delaying devices, and, specifically, many contacts having auxiliary tasks, are provided, which require high forces from the actuating members.

SUMMARY OF THE INVENTION

It is an object of the present invention to provide contact blocks in which every contact is a double interruption contact, in which the opening and closure of the contacts which can be normally open or closed, are obtained by means of axial movement of a shaped member or arm, so that the force needed for the axial movement of the contacts is substantially due to friction forces, caused by springs supplying the contact force.

Specifically, the contact auxiliary block, according to the present invention comprises an insulating support case housing an actuating slider having cams extending perpendicularly to the axis thereof on which abut conducting bridges connecting at least two moveable contacts, provided with perpendicular arms pivoted about a point on the insulating support case and pushed by spring means engaging the conductive bridges against the arms.

According to a preferred embodiment of the present invention, the bridges connecting the movable contact pairs have a substantial T shape with the cross-arm of the T carrying the movable contacts at the ends and at the center, an abutting portion for the spring means and a protrusion abutting against the arms. The leg of the T shaped bridge is provided with a fulcrum abutting against the insulating support case.

More specifically, the movable contacts on the cross-arm of each of the bridges may engage corresponding fixed contact carried by the arms connected to the insulating case and ending with screw clamps permitting the connection of the switch to external circuits.

According to a particularly preferred embodiment, the slider comprises cams axially indexed in two opposite directions and also the T-shaped conducting bridges are indexed so as to have the legs of the T's axially indexed in the two opposite directions, in order to have both normally open and normally closed contacts.

According to another preferred embodiment, the slider contains profiles or cams axially indexed with a high portion toward the tip of the slider and the T-shaped conducting bridges are indexed with the leg of the T toward the tip of the slider, in order to have all normally closed contacts.

According to a further embodiment, the slider has cams axially indexed with a high portion toward the base of the slider and the T shaped conducting bridges are indexed with the leg of the T toward the tip of the slider, in order to have all normally open contacts.

The features and advantages of present invention together with further features and advantages, will be better appreciated from the following detailed description of embodiments, provided with the enclosed drawing.

DETAILED DESCRIPTION OF THE PREFERRED EMBODIMENTS

Figure 1:
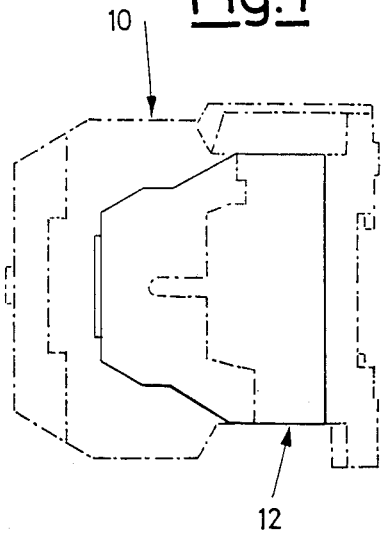
FIG. 1 is a schematic elevation view of an auxiliary switch block, according to the present invention, applied to a contactor.
Figure 2:
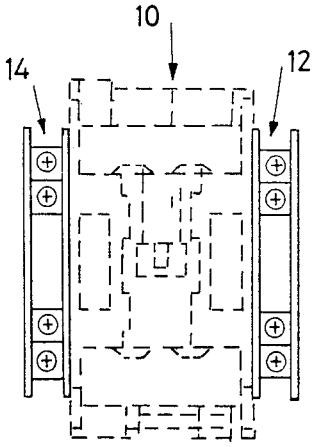
FIG. 2 is a schematic front view of two auxiliary switch blocks, according to present invention, applied to a contactor.

Referring to FIGS. 1 and 2, it is seen that a contactor 10 can have laterally applied one or two auxiliary switch blocks 12 and 14 having control or signalling duties.

Figure 3:
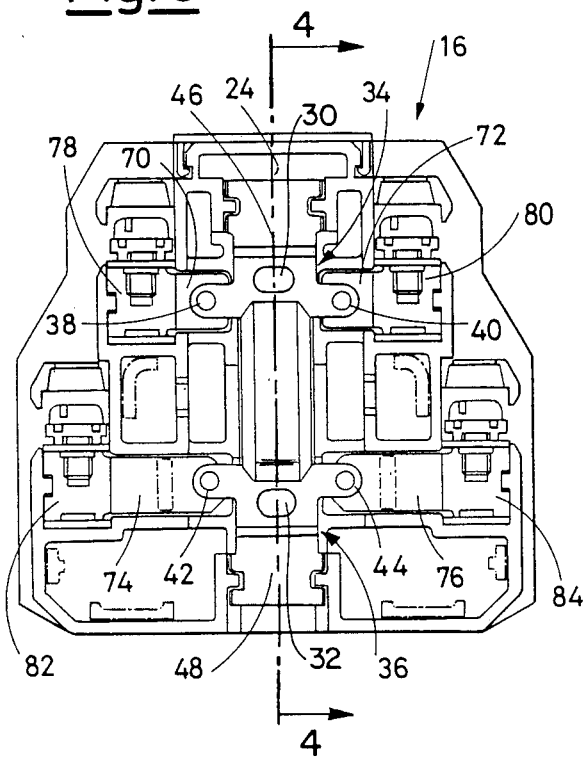
FIG. 3 is an open front view of a first embodiment of present invention containing a group of normally open contacts and a group of normally closed contacts.
Figure 4:
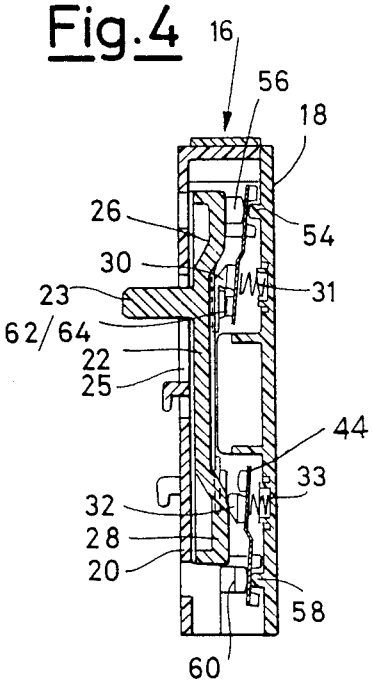
FIG. 4 is a sectional view, taken along the line 4—4 of the embodiment in FIG. 3.

An example of auxiliary switch blocks provided with a normally open contact group and with a normally closed contact group is shown in FIGS. 3 and 4. The auxiliary switch block consists of a supporting insulating housing 16, comprising a base 18, containing and supporting components, and a cover 20, which closes the housing. A slider 22 is movable along a sliding axis 24 by means of a finger 23, sliding in a slot 25. Slider 22 is, provided with profiles or cams 26 and 28 engaging protrunsions 30 and 32 pushed by springs 31 and 33, with T shaped movable bridges 34 and 36, provided with movable contact pairs 38, 40 and 42, 44 formed on the cross arms of the bridges and with arms 46 and 48 forming the legs of the T-shaped bridges formed to lean on protrusions 54, 56 and 58, 60 formed on the base 18 and cover 20, respectively of the housing 16 to allow rotation of the legs of the bridges 34 and 36 in order that their movable contacts 38, 40 and 42, 44 lean against or to separate from fixed contacts 62, 64, 66 and 68 carried by fixed arms 70, 72 and 74, 76 which terminate with respective screw clamps 78, 80, 82 and 84.

Figure 5:
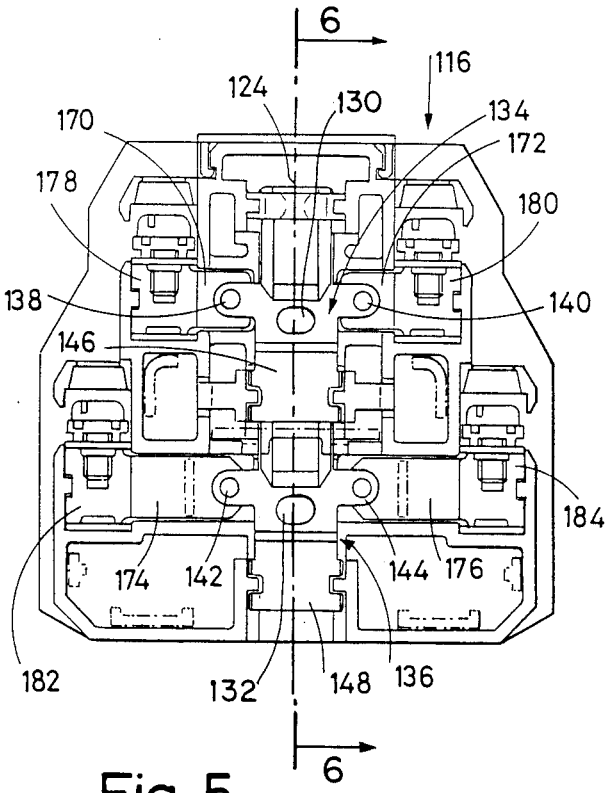
FIG. 5 is an open front view of a second embodiment of present invention containing two normally open contact groups.
Figure 6:
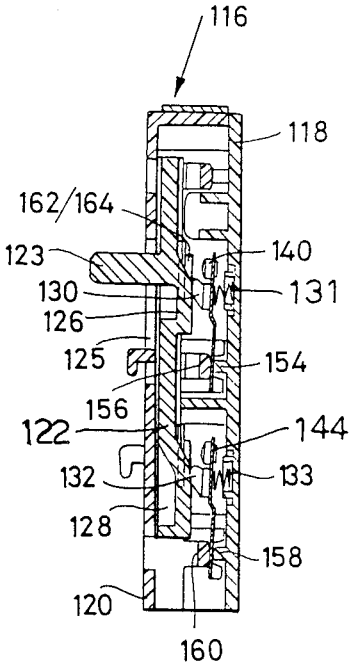
FIG. 6 is a sectional view, taken along the line 6—6 of the embodiment in FIG. 5.

A second embodiment of the auxiliary switch blocks 12, provided with two normally open contact groups, is shown in FIGS. 5 and 6.

The auxiliary switch block of the second embodiment includes an insulating support housing 116, comprising a base 118 containing and supporting components, and a cover 120 which closes the housing. A slider 122 movable along a sliding axis 124 by means of a finger 123, sliding in a slot 125 is provided with profiles or cams 126, 128 engaging protrusions 130 and 132, pushed by springs 31 and 33, with T shaped movable bridges 134 and 136, provided with movable contact pairs 138, 140 and 142, 144 formed on the cross-arms of the T-shaped bridges and with arms 146 and 148, forming legs of the T-shaped bridges formed to lean against 154, 156 and 158, 160 formed on base 118 and cover 120, respectively, of the housing 116 to allow rotation of the legs of the bridges 134 and 136 in order that their movable contacts 138, 140 and 142, 144 abut against or separate from fixed contacts 162, 164 and 166, 168 carried by fixed arms 170, 172 and 174, 176 terminating with respective screw clamps 178, 180 182 and 184.

The operation of the first embodiment of the auxiliary switch block, depicted in FIGS. 3 and 4 is as follows: When the auxiliary switch block 12 or 14 is assembled on the contactor 10, the finger 23 protruding from the slider 22, is engaged by a movable part of the contactor 10, so that, when said part is actuated, for example by the attraction of an electromagnet armature, the finger 23 of the slider trails the same and is moved from the raised position, specifically depicted in FIG. 4 to a lowered position in which the finger 23 is located at the bottom of the slot 25. This movement of the slider 22 results in engaging of the profile or cam 26 against the protrusion 30 of the bridge 34, overcoming the force of the spring 31, raising bridge 34 and moving the movable contacts 38 and 40, associated with bridge 34, from the closed position depicted in FIG. 4, to the open position. At the same time, the movement of slider 22, forces the profile or cam 28 to disengage from the protrusion 32 of the bridge 36 which, under the force of the spring 33, forces the movable contacts 42 and 44, associated with bridge 36 to move from the open position depicted in FIG. 4, to the closed position.

The operation of the second embodiment of the auxiliary switch block, depicted in FIGS. 5 and 6, is as follows:

When the auxiliary switch blade 12 or 14 is assembled in the contactor 10, the finger 123 protruding from the slider 122 is engaged by a movable part (not shown) of the contactor 10, so that, when the part is actuated, for example by the attraction of the armature of the electromagnet, the finger 123 of the slider 122 trails the same and is moved from the raised position, depicted in FIG. 6, to a lowered position, in which the finger 123 is located at the bottom of the slot 125.

This movement of the slider 122 releases both the profiles or cams 126 and 128 from the respective protrusions 130 and 132 of the bridges 134 and 136 which, being pushed by the respective springs 131 and 133, move the movable contacts 138, 140 and 142, 144 associated with the bridges 134 and 136, respectively, from the open position depicted in FIG. 6, to the closed position.

There has been disclosed heretofore the best embodiment of the invention presently contemplated. However, it is to be understood that various changes and modifications may be made thereto without departing from the spirit of the invention.

I claim:

1. Electric switch mechanism for relays and contactors, comprising:

a plurality of contacts, wherein each contact is a double interruption contact which can be normally open or normally closed;

an insulating housing;

a slidable actuating member which is movable between two end positions by a movable part of a relay or a contactor;

said insulating housing accommodating said actuating member and said contacts, said actuating member being an insulating member actuated externally of said housing and including cam means thereon;

spring members located in said housing;

each contact including a movable portion; and contact carrying means acted upon by said spring members and carrying said movable portions of said contacts;

said actuating member including a slider, said cam means being cams formed on an inner face of said slider, said contact carrying means including conducting bridges connecting at least two movable contact portions, said bridges being pivotably supported in said housing, said spring members forcing said bridges to engage against said cams;

each bridge being substantially T-shaped and having a first cross-arm carrying said movable contact portions and a protrusion cooperating with a respective one of said cams, and a second arm provided with a fulcrum abutting against said housing;

fixed arms connected to said housing and carrying fixed contact portions, said fixed arms terminating with screw clamps for connection with external circuits;

said cam means, upon an axial movement of said actuating member from one of said end positions to another of said end positions, acting on said contact carrying means to move said movable portions relative to said fixing portions against a force of said spring members, so that opening and closure of said contacts are obtained by the axial movement of said actuating member, and wherein a force required for said axial movement is substantially due to friction forces caused by said spring members supplying a contact force between the respective movable and fixed portions.

2. Electric switch mechanism according to claim 1, wherein said slider has two cams thereon, said two cams being indexed in two opposite directions, said second arms of T-shaped bridges being indexed in two opposite directions to provide normally open and normally closed contacts in the switch.

3. Electric switch mechanism according to claim 1, wherein said slider has two cams thereon, said cams having high portions indexed in the same direction towards a tip of said slider and said second arms of said T-shaped bridges being both indexed towards the tip of said slider to provide all normally closed contacts in the switch.

4. Electric switch mechanism according to claim 1, wherein said slider has two cams thereon, said cams having high portions indexed towards a base of said slider and said second arms of said T-shaped bridges being indexed towards a tip of said slider to provide all normally open contacts in the switch.

* * * * *